US005605444A

United States Patent [19]

Paton et al.

[11] Patent Number: 5,605,444

[45] Date of Patent: Feb. 25, 1997

[54] PUMP IMPELLER HAVING SEPARATE OFFSET INLET VANES

[75] Inventors: Alan Paton, Nottinghamshire, United Kingdom; Bruno Schiavello, Millburn, N.J.; Giovanni Rigamonti, Seveso, Italy

[73] Assignee: Ingersoll-Dresser Pump Company, Liberty Corner, N.J.

[21] Appl. No.: 578,299

[22] Filed: Dec. 26, 1995

[51] Int. Cl.[6] ..... F01D 1/02

[52] U.S. Cl. ..... 416/183

[58] Field of Search ..... 416/183

[56] References Cited

U.S. PATENT DOCUMENTS

| | | | |
|---|---|---|---|
| 3,893,817 | 7/1975 | Hackbarth et al. | 29/156.8 |
| 4,093,401 | 6/1978 | Gravelle | 416/185 |
| 4,111,597 | 9/1978 | Grossi et al. | 415/143 |
| 4,520,541 | 6/1985 | Miki et al. | 29/156.8 |
| 4,653,976 | 3/1987 | Blair et al. | 415/1 |
| 4,778,341 | 10/1988 | Corradini et al. | 416/183 |
| 4,815,935 | 3/1989 | Gottemoller | 415/211 |
| 4,900,228 | 2/1990 | Yapp | 416/183 |
| 5,002,461 | 3/1991 | Young et al. | 416/183 |
| 5,120,196 | 6/1992 | By et al. | 416/180 |
| 5,213,473 | 5/1993 | Fiala | 416/183 |
| 5,215,439 | 6/1993 | Jansen et al. | 416/183 |
| 5,368,443 | 11/1994 | Turkia et al. | 416/184 |

FOREIGN PATENT DOCUMENTS

| | | | |
|---|---|---|---|
| 215476 | 9/1941 | Switzerland | 416/183 |
| 653428 | 3/1979 | U.S.S.R. | 416/183 |
| 496820 | 12/1938 | United Kingdom | 416/183 |
| 195548 | 3/1952 | United Kingdom | 416/183 |

*Primary Examiner*—John T. Kwon
*Attorney, Agent, or Firm*—Robert F. Palermo

[57] ABSTRACT

A fluid impeller for a centrifugal pump includes a hub having a substantially disk-like form with a center and an edge, circular symmetry, and provision for being rotatably driven. A first plurality of pumping vanes projects substantially perpendicularly from a first surface of the hub and extends radially outwardly from a locus near the center of the hub to another locus near the edge of the hub. These vanes provide a high pressure head with a small impeller diameter. A second plurality of separate and twisted inlet vanes also projects substantially perpendicularly from the first surface of the hub and extends radially outwardly to the locus near the center of the hub from another locus nearer the center of the hub. The separate second plurality of vanes, by turning and pre-pressurizing the fluid, provides an impeller having capability of cavitation-free pumping at low net positive suction head (NPSH). A front shroud can be used which partially or totally covers the first and/or second plurality of vanes.

13 Claims, 3 Drawing Sheets

PUMP IMPELLER HAVING SEPARATE OFFSET INLET VANES

BACKGROUND OF THE INVENTION

This invention relates generally to single-stage end-suction centrifugal pumps and more particularly to centrifugal pumps with both open and shrouded impellers for low-flow, high head applications.

Centrifugal end-suction pumps are well known and are in wide use. Many different types of such pumps are available, but not many are specifically designed for low flow rates where a high head is desired, along with good efficiency, good suction performance, and high pump reliability (or low maintenance). In most cases, a low-flow duty is met with a pump sized for more flow than is required by the intended application. This provides the required pumping capacity, but it means the pump has to operate off design where not only is energy wasted, but the potential for damage is increased because of highly unsteady hydraulic loads due to internal flow separation. Furthermore, the generation of high head at low flow is more difficult, since a high head coefficient must be achieved in order to maximize head for a given impeller diameter while maintaining reasonable hydraulic load levels for both steady and unsteady components of radial and axial forces.

The most common pump design has an impeller with a narrow width and a low number of vanes, which leads to a large diameter impeller and a large size/high weight pump. The suction performance in relation to cavitation is only fair.

Some special pumps designed for this duty have a narrow small diameter discharge casing with a correspondingly narrow, multi-vane, optimized-diameter impeller. Multivane impellers for low-flow operation generally do not have inlet conditions suitable for operation at low local suction pressure. This is due to the poor matching of blade angle to flow angle and the blockage (or occlusion) of the inlet caused by the vanes themselves. As a consequence of this, the potential for poor cavitation behavior is increased, which invites several negative effects, namely: a) the pump produces pronounced decay of head and efficiency unless high suction pressure is provided by highly elevating the feed tank (which increases installation cost of the tank), or by reducing the pump motor speed; b) the the pump is subjected to highly unsteady flow, even surge, because of pressure pulsations induced by large vapor volumes inside the pump, thereby reducing pump reliability and increasing maintenance costs; and c) the impeller can be quickly damaged by cavitation erosion along with other pump components, such as the wear ring, suction vanes, volute tongue, or diffuser vanes.

Cavitation, which contributes to damage and loss of efficiency, is caused by the hydraulic pressure head at the impeller inlet falling below the vapor pressure of the working fluid. This results in formation of bubbles and their subsequent collapse at the surface of the impeller. Collapse of millions of such bubbles, each producing a micro-shock, locally erodes the impeller surface and ultimately causes pitting, perforation, and failure of the impeller.

It is highly desirable for a pump, which needs to operate with small capacity and high head, to have a design capacity close to the operating capacity in order to minimize all the negative effects related to off-design operation. Such a pump should be optimized for low flow coefficient, high head coefficient, high efficiency, and low net positive suction head (NPSH). This suggests use of a small impeller diameter and a large number of vanes with a steep blade angle and narrow width at the exit of the impeller, along with low blade blockage (a low number of vanes) and a small blade angle at the inlet.

The foregoing illustrates limitations known to exist in present centrifugal pumps. Thus, it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a fluid impeller for a centrifugal pump including a hub having a substantially disk-like form with first and second surfaces, a center and an edge, an axis of rotation, circular symmetry about the axis, and provision for being rotatably driven; a first plurality of vanes projecting substantially axially and perpendicularly from the first surface of the hub and extending radially outwardly from a locus near the center of the hub to another locus near the edge of the hub; and a second plurality of vanes, separate from the first plurality of vanes, projecting substantially axially and perpendicularly from the first surface of the hub and extending radially outwardly to the locus near the center of the hub from another locus nearer the center of the hub.

The foregoing and other aspects will become apparent from the following detailed description of the invention when considered in conjunction with the accompanying drawings.

DETAILED DESCRIPTION

Figure 1:
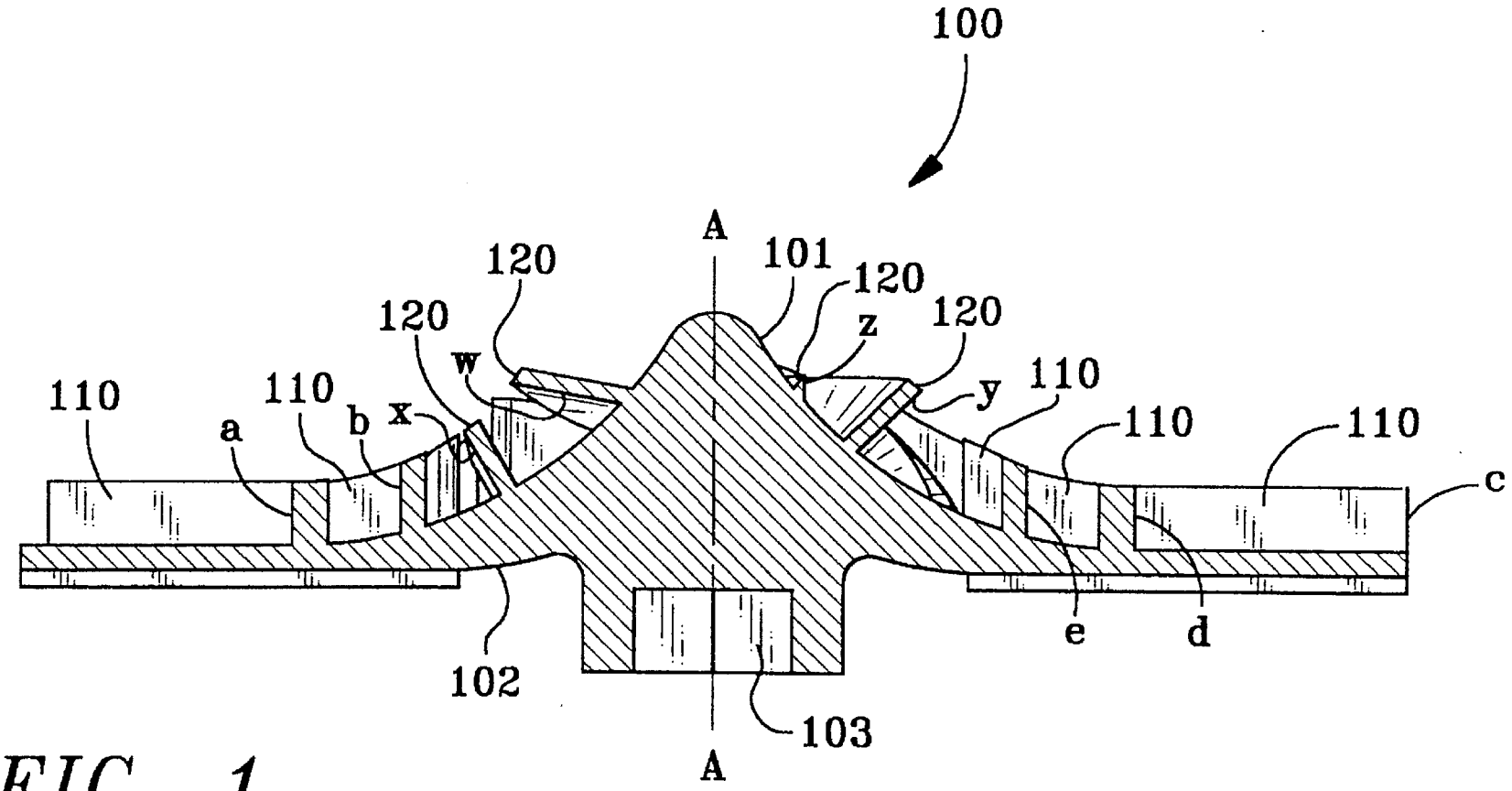
FIG. 1 is a schematic elevation view showing a cross-section of the substantially disk-like hub along with the radial extent of the first and second pluralities of vanes.
Figure 2:
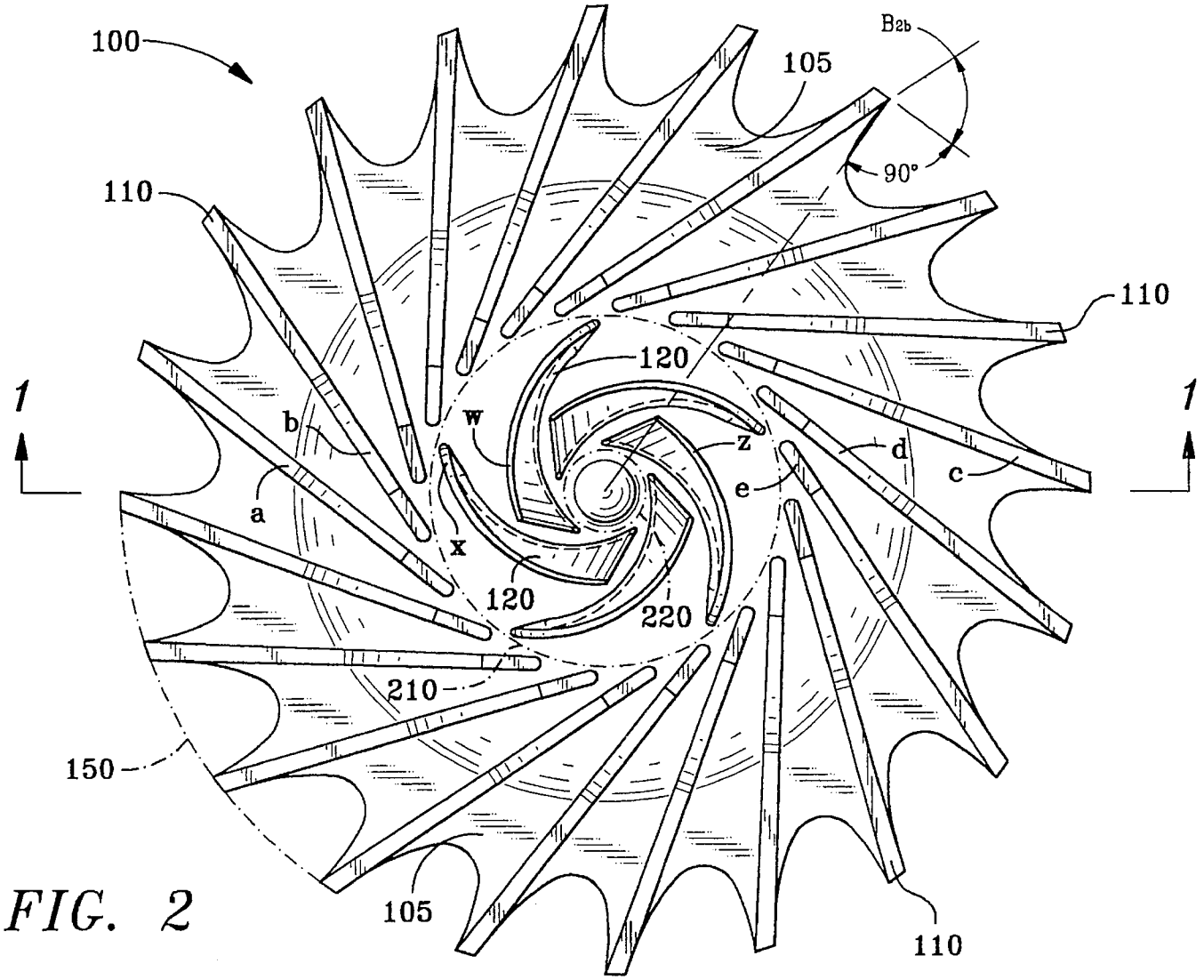
FIG. 2 is a schematic plan view of the impeller showing an open, unshrouded embodiment of the impeller.

The design problems described above are solved by utilizing a separate, offset, row of twisted vanes at the inlet of the impeller while maintaining a multivane concept at the outlet to produce a higher discharge head coefficient. Thus vane inlet angles are optimized and, by selecting fewer inlet vanes, inlet blockage is reduced. The capability of the resulting pump to operate at low suction pressures is thus increased, and the high discharge head capability of the pump is maintained. The specific detailed description of one preferred embodiment of the invention is provided below by reference to the drawings. The drawings of the impeller do not include the pump housing with its base, inlet and discharge ports, and rotary drive provisions. These are of standard design and are not part of the claimed invention FIGS. 1 and 2 are schematic representations of an open impeller 100 showing a cross-sectional view (in the direction of arrows 1—1 in FIG. 2) and a plan view, respectively, of an impeller, having separate, offset, and twisted inlet vanes, for a centrifugal fluid pump. The invention is best described by reference to both Figures, in which a given number is used to designate the same feature in all cases where shown. The impeller 100, seen in cross-section and plan views, has a disk-like hub 105 with circular symmetry, a first (top) surface 101, a second (bottom) surface 102, an axis of rotation A—A, and a non-cylindrical bore provision 103 for accepting a rotary drive member. Note that the non-cylindrical bore 103 could also be a shaft projecting from the second surface of the hub, as determined by spatial limitations and design considerations for the application.

A first plurality of vanes 110 extend from a substantially circular locus 210 near the center of the hub, outwardly to another locus 150, near the edge of the hub, and project substantially axially and perpendicularly from the first surface 101 of the hub 105. The impeller 100 rotates counterclockwise as viewed in FIG. 2, and the vanes 110 are arranged such that the outer ends trail the inner ends when the impeller 100 is rotating. This results in an increase of pressure from the center of the impeller 100 to the edge thereof. Note that the vanes 110 are shown as having a substantially straight radial configuration for ease of illustration, but they may also be designed with varying degrees of curvature, as dictated by the application. Moreover, the blade angle $B_{2b}$ (seen in FIG. 2) at the impeller outer edge can vary from nearly 0° (tangential blade) to 90° (radial blade).

A second plurality of vanes 120, also projecting substantially axially and perpendicularly from the first surface 101 of the hub 105, extend to the locus 210, near the center of the hub 105, from another locus 220, nearer to the center of the hub 105. These vanes 120 are twisted and separate from the vanes 110 of the first plurality of vanes, and, since there are preferably fewer of the vanes 120, are offset from the vanes 110. It would be possible to have the same number of vanes 120 as there are vanes 110, but, in order to not unduly restrict (or occlude) the inlet flow path, it is generally preferred to have fewer inlet vanes 120. The possibility for such restriction of inlet flow path is readily seen in FIG. 2, in which there are only one-fourth as many inlet vanes 120 as there are pumping vanes 110.

The cross-section of FIG. 1 is taken along the line 1—1 in FIG. 2 and both Figures are labeled with letters a, b, c, d, and e to indicate the partial pumping vanes 110 seen in the Figure. Letters w, x, y, and z indicate the portions of inlet vanes 120 visible in FIG. 1. FIG. 2 also shows the impeller 100 as having a hub 105 with a scalloped edge which is cut back from the edge between the vanes 110 to reduce centrifugal loads on the hub. However, the edge can be fully circular, as may be required for certain applications.

Figure 3:
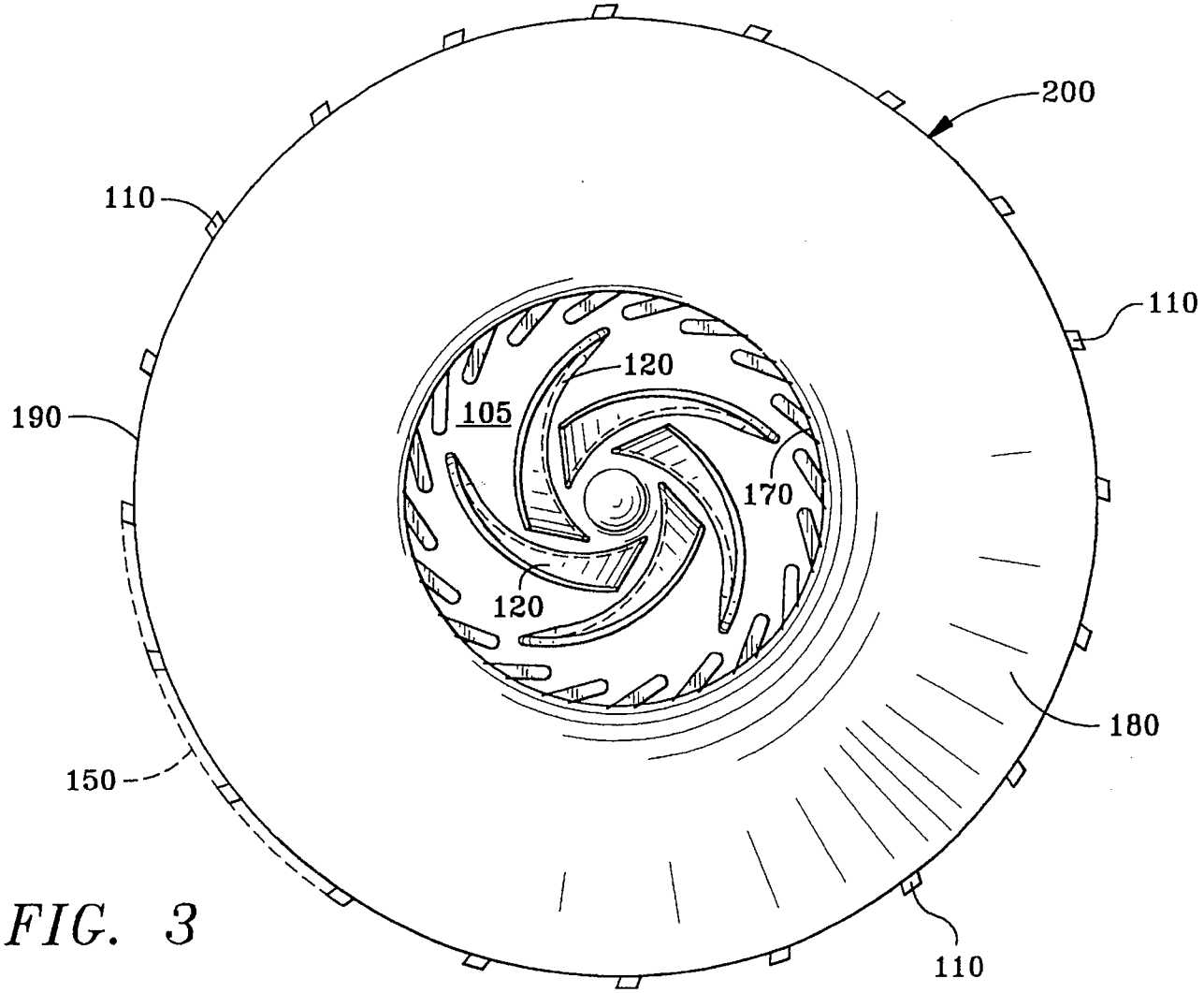
FIG. 3 is a schematic plan view of the impeller showing a shrouded embodiment.

FIG. 3 shows an impeller 200, as in FIG. 2, except that this one is shrouded. The shroud 180 is shown as having an inner edge 170 and an outer edge 190 and as overlaying the vanes 110, a number of which are represented in dotted lines in the Figure. It is attached to the vanes 110 (usually cast with the impeller) and may have a greater or lesser extent of coverage of the vanes than that shown, depending on overall design considerations. The shroud 180 reduces rotary fluid drag between the housing and the impeller 200 during operation and also reduces noise and wear of the housing and impeller 200 which would occur due to turbulence induced in the pumped fluid by an open impeller 100. The shroud 180 can cover the second plurality of vanes, if required by some applications.

In operation, either impeller 100 or 200 operates in essentially the same manner. The impeller 100, 200 rotates counterclockwise, as viewed in FIGS. 2 and 3, in a pump housing (not shown) and receives working fluid from the housing inlet (not shown). With appropriate orientation of the vanes, the impeller, of course, could rotate clockwise. Inlet vanes 120 pre-pressurize the fluid, effectively raising the local suction head, and drive the fluid from the inlet outwardly to the pumping vanes 110 which increase the speed and pressure of the fluid and deliver the fluid to the housing discharge (not shown) at the desired high outlet head coefficient. By pre-pressurizing the fluid, the inlet vanes 120 effectively increase the suction head, thereby reducing or eliminating cavitation damage and pumping efficiency losses. This permits use of properly sized pumps for each application and results in economies due to operation of pumps within their design parameters.

Having described the invention, what is claimed is:

1. A fluid impeller for a centrifugal pump comprising:

a hub having a substantially disk-like form with first and second surfaces, a center and an edge, an axis of rotation, circular symmetry about the axis, and provision for being rotatably driven;

a first plurality of vanes projecting substantially axially and perpendicularly from the first surface of said hub and extending radially outwardly from a locus near the center of said hub to another locus near the edge of said hub; and a second plurality of vanes, separate from said first plurality of vanes; said second plurality of vanes being twisted, projecting substantially axially and perpendicularly from said first surface of said hub, and extending radially outwardly to said locus near the center of said hub from another locus nearer the center of said hub.

2. The impeller of claim 1, wherein the number of vanes in said second plurality is less than the number of vanes in said first plurality.

3. The impeller of claim 1, further comprising:

a shroud substantially parallel to said first surface of said hub, covering at least said first plurality of vanes, and attached to said vanes.

4. The impeller of claim 1, wherein the edge of said hub extends to a lesser diameter between the vanes of said first plurality of vanes than its diameter under said vanes so as to have a scalloped edge.

5. In a centrifugal pump with a housing having a suction inlet and discharge outlet, an impeller for pumping fluids, and a rotary drive for said impeller, in combination with said centrifugal pump, the improvement, comprising:

an impeller hub having a substantially disk-like form, said hub having a center and an edge, circular symmetry, and provision for being rotatably driven;

a first plurality of vanes projecting substantially perpendicularly from one surface of said hub and extending substantially radially outwardly from a locus near the center of said hub to another locus near the edge of said hub; and a second plurality of vanes, separate from said first plurality of vanes; said second plurality of vanes being twisted, projecting substantially perpendicularly from said one surface of said hub and extending radially outwardly to said locus near the center of said hub from another locus nearer the center of said hub.

6. The improvement of claim 5, wherein the number of vanes in said second plurality is less than the number of vanes in said first plurality.

7. The improvement of claim 5, further comprising:

a shroud, axially offset from the first surface of the impeller hub, covering the first plurality of vanes outwardly from the locus near the center of the hub to a location near the edge of said hub, and attached to said vanes.

8. The impeller of claim 5, wherein the edge of said hub extends to a lesser diameter between the vanes of said first plurality of vanes than its diameter under said vanes so as to have a scalloped edge.

9. In a centrifugal pump with a housing having a substantially axial suction inlet and a discharge outlet, a rotatable impeller with a disk-like hub, and a first plurality of vanes projecting substantially perpendicularly from one surface of said hub and extending substantially radially outwardly from a locus near the center of said hub to another locus near the edge of said hub, the improvement, in combination with said centrifugal pump, comprising:

a second plurality of vanes; said second plurality of vanes being twisted, projecting substantially perpendicularly from said one surface of said hub near the suction inlet, and extending radially outwardly therefrom to said locus near the center of said hub.

10. The improvement of claim 9, wherein the number of vanes in said second plurality of vanes is less than the number of vanes in said first plurality of vanes.

11. The improvement of claim 9, further comprising:

a shroud, axially offset from the first surface of the impeller hub, covering the first plurality of vanes outwardly from a location near to the locus near the center of the hub to a location near the edge of said hub, and attached to said vanes.

12. The improvement of claim 11, wherein the shroud also covers at least a portion of the second plurality of vanes.

13. The improvement of claim 11, wherein the shroud also has a scalloped edge.

* * * * *